US012036593B2

(12) United States Patent
Pritz et al.

(10) Patent No.: US 12,036,593 B2
(45) Date of Patent: Jul. 16, 2024

(54) FLEXIBLY ROLLING METAL STRIP MATERIAL

(71) Applicant: Muhr und Bender KG, Attendorn (DE)

(72) Inventors: Stephan Pritz, Schwerte (DE); Stefan Hörth, Schalksmühle (DE)

(73) Assignee: Muhr und Bender KG, Attendorn (DE)

( * ) Notice: Subject to any disclaimer, the term of this patent is extended or adjusted under 35 U.S.C. 154(b) by 259 days.

(21) Appl. No.: 17/780,120

(22) PCT Filed: Nov. 27, 2020

(86) PCT No.: PCT/EP2020/083761
§ 371 (c)(1),
(2) Date: May 26, 2022

(87) PCT Pub. No.: WO2021/105447
PCT Pub. Date: Jun. 3, 2021

(65) Prior Publication Data

US 2022/0410234 A1 Dec. 29, 2022

(30) Foreign Application Priority Data

Nov. 27, 2019 (DE) ..... 10 2019 132 133.6

(51) Int. Cl.
*B21B 37/58* (2006.01)
*B21B 1/24* (2006.01)

(52) U.S. Cl.
CPC ..... *B21B 37/58* (2013.01); *B21B 1/24* (2013.01)

(58) Field of Classification Search
CPC ..... B21B 37/48; B21B 37/52; B21B 38/06; B21B 38/08; B21C 47/345; B21C 47/3458
See application file for complete search history.

(56) References Cited

U.S. PATENT DOCUMENTS 9,156,073 B2 * 10/2015 Wang ..... B21C 37/083
2017/0260005 A1 * 9/2017 Eichner ..... B21C 1/30

FOREIGN PATENT DOCUMENTS

| | | | |
|---|---|---|---|
| DE | 4009862 A1 | 10/1991 | |
| DE | 29909850 U1 | 9/1999 | |
| DE | 10315357 A1 | 11/2004 | |
| EP | 3216537 A2 | 9/2017 | |
| EP | 3566788 A1 | 11/2019 | |
| WO | WO-2020090453 A1 * | 5/2020 | ..... B21B 37/68 |

OTHER PUBLICATIONS

Translation of WO-2020090453 (Year: 2020).*
International Search Report and Written Opinion for PCT/EP2020/083761 mailed Mar. 9, 2021 (11 pages; with English translation).

* cited by examiner

*Primary Examiner* — Bobby Yeonjin Kim
(74) *Attorney, Agent, or Firm* — Bejin Bieneman PLC

(57) ABSTRACT

An apparatus for processing metallic strip material comprises a feeder for feeding strip material; a strip drive with at least one controllable traction drive with a carrier and a motor, a drivable traction loop and a press assembly, wherein the power of the motor and the pressing force of the press assembly are variably controllable; a roller assembly for flexible rolling; a measuring device for measuring a physical parameter of a component acting on the strip material; wherein the driving power of the motor is controllable on the basis of the physical parameter measured by the measuring device.

20 Claims, 4 Drawing Sheets

FLEXIBLY ROLLING METAL STRIP MATERIAL

CROSS-REFERENCE TO RELATED APPLICATIONS

This application is a national stage of, and claims priority to, Patent Cooperation Treaty Application No. PCT/EP2020/083761, filed on Nov. 27, 2020, which application claims priority to German Application No. DE 10 2019 132 133.6, filed on Nov. 27, 2019, which applications are hereby incorporated herein by reference in their entireties.

BACKGROUND

In flexible rolling, a strip material with a substantially uniform sheet thickness is rolled out into strip material with variable sheet thickness along its length by changing the rolling gap during the process. The sections of varying thickness produced by flexible rolling extend transversely to the longitudinal direction or rolling direction of the strip material. After flexible rolling, the strip material can be easily wound up to a coil and fed to further processing elsewhere, or it can be processed further directly, for example by cutting the strip material to length to form individual sheet elements.

From DE 103 15 357 A1, a method for flexible rolling of metal strip is known, with a first coiling device for uncoiling, from which strip with a defined strip initial thickness is uncoiled, a roll stand with an adjustable roll gap, and a second coiling device onto which the rolled strip is coiled with a reduced strip end thickness compared to the strip initial thickness. First strip buffer means are provided between the first coiling device and the roll stand, and second strip buffer means are provided between the roll stand and the second coiling device. The strip buffer means each comprise a plurality of rollers over which the strip material is guided in the form of an "S" with bends at least partially lying over each other. By a controlled movement of at least one of the rollers of the strip buffer means, the S is distorted in such a way that the length of the metal strip is changed between the inlet and the outlet into or out of the strip buffer means. This type of strip buffer means with several rollers is also called a dancer system.

From EP 3 216 537 A2, a device for transporting metallic long material is known, in particular strip material, wire material, tube material or profile material. The device comprises two controllable chain drive units, each with an endless chain, between which the long material is passed, two controllable press assemblies, each of which for exerting a pressing force on the associated chain in the direction of the long material, and a controllable adjusting unit, which is mechanically connected to the chain drive units and can move them in the longitudinal direction of the long material. The adjusting unit comprises a length-adjustable linear drive in the form of a hydraulic piston-cylinder unit. By actuating the piston-cylinder unit, the chain drive units are moved relative to a stationary component in or against the transport direction of the strip material. The chain drive units each comprise a carrier, a drive roller, a guide roller and a motor that drives the respective chain uniformly.

From DE 299 09 850 U1, a device for pulling or braking metal strips between two endlessly circulating chain systems arranged opposite each other and driven by sprockets is known. The chain systems clamp the strip with carriage-like roller blocks which are guided on strips in a straight driving area.

SUMMARY

The present disclosure relates to an apparatus and a method for flexibly rolling of metallic strip material. The apparatus for flexibly rolling of metallic strip material is simply constructed, has a small space requirement and which, optionally, can be integrated into a process chain with further processing devices. The method enables efficient production of flexibly rolled strip material or parts made therefrom.

An apparatus for processing metallic strip material is disclosed, comprising: a feeder for feeding metallic strip material; a strip driving device comprising at least one controllable traction drive unit with at least one motor and an endless traction mechanism, i.e., a traction loop, drivable by the motor, as well as a press assembly for pressing the traction mechanism against the strip material, wherein the driving power of the motor and the pressing force of the press assembly are variably controllable during operation, so that a driving force acting from the traction mechanism under frictional contact on the strip material is variably adjustable; a roller assembly for flexibly rolling the strip material in order to produce a variable sheet thickness over the length of the strip material; a measuring device, in particular a tension measuring device, which is arranged and/or configured to measure a physical variable acting on the strip material, in particular an inlet tensile force; wherein the drive power of the motor of the strip drive is controllable based on the physical variable measured by the measuring device. The traction drive unit is held stationary, in particular in the longitudinal direction, for example fixed to a carrier element and/or housing. By changing the drive power or drive torque of the motor, which rotationally drives the endless traction mechanism, the drive force acting from the traction mechanism on the strip material can be variably adjusted as required.

An advantage of this apparatus is that it has a simple and compact design due to the traction drive units. The infeed tensile force, i.e. the tensile force acting on the strip material at the inlet side of the roller assembly, can be controlled directly by controlling the drive power of the motor. No or only small displacements of the strip drive are necessary, which has an overall favourable effect on the space requirement of the apparatus. Even if the available space is limited, the system can be integrated into a process chain with further processing devices. In particular, further processing steps can be carried out upstream and/or downstream, since the tension upstream of the tension drive unit before the roller assembly or downstream of the tension drive unit after the roller assembly is independent of the process tension in the area of the roller assembly. If a strip buffer is used upstream of the roller assembly, other otherwise required units, such as a dancer unit or a loop unit, can optionally be omitted. In flexible rolling, the hydraulic adjustment of the work rolls is the main process, which is possible via thickness control, position control or mass flow control. This results in large variations of the process parameters tensile force, speed and rolling force. By means of the fixed drive chain unit, with the contact forces acting on the strip material and the varying drive power of the motor for changing the rotational speed of the traction mechanism, these variations can be harmonised in terms of process technology.

In the context of the present disclosure, a traction drive unit is understood to mean, in particular, a drive unit that transmits a drive power (speeds and torques) with the aid of slack and/or flexible machine elements. Such a flexible machine element can essentially transmit tensile forces and is thus also referred to as a traction mechanism. Preferably, positive-locking traction mechanism, such as a chain or a toothed belt, are used, which always have the same circumferential speed over the circumference. A drive unit with a chain as the traction mechanism can accordingly be referred to as a chain drive unit; a drive unit with a toothed belt can accordingly be referred to as a toothed belt drive unit.

According to a possible embodiment, a second strip drive can be arranged behind the roller assembly in the direction of movement of the strip material. The use of a second strip drive has the advantage that the processing respectively transport direction of the strip material can also be reversed. In this case, the second strip drive is located in front of the roller assembly in the direction of movement of the strip material, and the first strip drive is located behind it. In a possible specification, the second strip drive can be supported against a stationary component by at least one spring unit. The drive power of the motor of the second strip drive can be kept constant. Any elements that are suitable for absorbing, storing and releasing external forces can be used as spring units. For example, mechanical, hydraulic, electric or pneumatic springs and/or energy accumulators can be used as spring units.

When using two strip drives, one upstream and one downstream of the rolling unit, the speeds of the two devices can be adjusted according to the volume consistency of the strip material. Alternatively, a control with constant elongation is also possible, i.e. the drive speed of the downstream drive device of the strip material in the transport direction of the strip material is slightly faster than the drive speed of the upstream drive device. The difference in speed between the two drive devices, taking into account the volume consistency, can be up to 3%, for example.

The two strip drives preferably have the same design in terms of structure and mode of operation. It is therefore understood that all details described within the scope of the present disclosure with respect to one of the two strip drives or individual components thereof, respectively, may equally apply to the second strip drive, unless otherwise stated. In particular, the second strip drive also comprises at least one controllable traction drive unit with a motor, an endless traction mechanism is rotatably driveable by the motor, and a press assembly for pressing the traction mechanism against the strip material. The traction mechanism comprises in particular positive-locking machine elements, such as a chain or a toothed belt.

By controlling the motor drive power on the basis of a physical parameter representative of the rolling process, the tensile force acting on the strip material is controllable as required to support the rolling process for producing the desired thickness profile in the strip material. In general, different control concepts of the flexible roller assembly are possible, so that accordingly different physical parameters of apparatus components acting on the strip material can also be measured and used to control the motor drive power. According to a first possibility, the measuring device can be designed as a tension measuring device, which can be arranged between the strip drive and the roller assembly in order to measure as a physical parameter the inlet tensile force acting on the strip material. According to an alternative or additional possibility, a force measuring device can be provided which can measure as a physical parameter a signal representing the rolling force of the roller assembly. According to a further alternative or supplementary possibility, a position measuring device can be provided which can be arranged on a setting unit for a roll in order to measure the setting position of the setting unit for a roll as a physical parameter.

According to an embodiment, a second tension measuring device may be arranged between the roller assembly and the second strip drive in order to measure the outfeed tensile force acting on the strip material on the outfeed side. The drive power of the motor of the second strip drive is controllable in particular on the basis of the outfeed tensile force determined by the second tension measuring device.

Furthermore, a strip buffer may be arranged between the second strip drive and a downstream processing device, in which the strip material can be buffered as it passes between a buffer inlet and a buffer outlet.

In at least one of the tension measuring devices, i.e., in the first and/or the second tension measuring device, the contact pressure of the respective pressure unit can be controlled on the basis of the tensile force measured by the respective tension measuring device. In particular, the drive power of the motor and/or the contact pressure of the pressure unit can be variably controlled during operation, so that a target tensile force acting on the strip material by the traction mechanism under frictional contact can be variably adjusted.

According to a possible embodiment, a strip buffer is provided in which the strip material can be stored as it passes between a buffer inlet and a buffer outlet. In this embodiment, a dancer unit and/or a loop unit may be omitted, as an option. The strip buffer may comprise a vertical buffer, a horizontal buffer or a loop buffer. A vertical accumulator is characterised in that strip material is stored in the vertical direction, with the space requirement in the horizontal direction being correspondingly small. A horizontal accumulator stores strip material in the horizontal direction, wherein the space requirement in the vertical direction is correspondingly small.

The motor of the traction drive unit generates a rotary motion to rotate the traction drive. In this respect, the motor can also be referred to as a rotary drive or rotary motor. The drive power of a rotary drive results in particular from the product of speed and torque. A change in the motor drive power can therefore take place by changing the drive torque and/or the drive speed. The motor(s) can be designed as a hydraulic motor or electric motor, in particular as a hydraulic or electric direct drive. A torque motor, for example, can be used as a direct electric drive. Such hydraulic or electric motors enable high torques at relatively low speeds and are highly dynamically controllable. Preferably, the strip drive or the individual components of the strip drive are configured to accelerate and/or decelerate the strip material with at least 3 $m/sec^2$.

A strip drive may be configured, for example, to generate tensile forces of at least 1 $N/mm^2$, preferably at least 10 $N/mm^2$ and/or less than 120 $N/mm^2$ with respect to the cross-sectional area of the strip material. When using a relatively strong strip material, such as steel, the strip drive may be configured to generate tensile forces of at least 50 $N/mm^2$ and/or of less than 120 $N/mm^2$ with respect to the cross-sectional area of the strip material. For strip material with lower tensile strength, such as aluminium, the strip drive can be dimensioned with a lower tensile force to be generated, for example up to 90 $N/mm^2$.

The strip drive may have a drivable first axle which is rotationally drivable by the motor to transmit drive torque to the traction mechanism, and a second axle which is rotationally driven by the traction mechanism. One or two motors can be provided to drive the first axle. If two motors are used, they may be controllable independently of each other, wherein the two motors may be driven synchronously with each other to jointly drive the first axle.

According to an embodiment, the apparatus may have two controllable traction drive units between which the strip material can be passed in frictional contact, so that the strip material is moved in the direction of movement of the traction sections in contact with the strip material when the traction drive units are in operation. The two tension drive units can have the same design in terms of structure and mode of operation. Using two motors per drive unit results in a total number of four motors for the strip drive. The two traction drive units can each have an associated press assembly, which exerts a pressing force on the respective traction mechanism in the direction of the strip material. Alternatively, a single press assembly may be provided which can apply both traction drive units towards each other, or move them away from each other. A press assembly can, for example, have one or more linear drives, in particular a piston-cylinder unit, which can generate a force transverse to the direction of the strip.

According to a possible implementation, a traction drive unit may comprise a plurality of interconnected traction members forming an endless traction mechanism, i.e., traction loop. Furthermore, the two traction drive units can each have a carrier, a drive wheel and a return wheel or return pulley, around which the endless traction mechanism is arranged in a revolving manner. The drive wheel and the return wheel are rotatably mounted on the first carrier at a distance from each other. The drive wheel, which is rotatably drivable by the motor, is in a preferably form-locking engagement with the traction mechanism to transmit torque from the motor to the traction mechanism. The traction mechanism may have a plurality of circumferentially distributed friction elements. The friction elements are configured in particular to come into frictional contact with the strip material as the traction mechanism moves circumferentially and to move the strip material, thus clamped between the two opposing traction mechanism assemblies, in the direction of advance. One or more friction elements may each be arranged on one of the traction mechanism members. It is provided in particular that the friction elements each have a friction lining which is matched to the material of the strip material in such a way that static friction is generated between the friction lining and the strip material. By matching the forces and materials of the components involved in the movement in such a way that essentially only static friction is generated on the strip material, wear is kept low and the surface of the strip material is protected.

One or more further processing devices may be provided. For example, a processing device can be arranged between the feeder and the strip drive, in particular a strip cleaning unit.

According to a preferred embodiment, a control unit is provided for controlling the feed speed and/or the tensile force of the strip material. For this purpose, the control unit can control one or more components of one or more strip drives. In particular, the control unit can control at least the drive motor and the press assembly and, for this purpose, is connected to said units in terms of control technology. In particular, it is provided that each individual control variable can be set individually by the control unit. Furthermore, the individual control variables are preferably continuously adjustable between a maximum value and a minimum value. As will be understood, the control unit is a computing device such as an electronic control unit or the like having a processor and a memory. As such, operations of the control unit may be carried out according to program instructions stored and/or executed by the processor as software, firmware, or the like.

The object is further solved by a method for processing metallic strip material, comprising the steps: driving the strip material by a strip drive, with the strip material being uncoiled from a feeder and fed to a downstream device for flexible rolling, wherein the strip drive including at least one controllable traction drive unit with a motor, an endless traction mechanism which drivable by the motor, and a press assembly for pressing the traction mechanism against the strip material; sensing an inlet tensile force acting on the strip material by a tension measuring device arranged between the strip drive and the flexible roller assembly; controlling the power of the motor of the strip drive in dependence of the inlet tensile force measured by the tension measuring device.

The method offers the same advantages that have already been described above in connection with the apparatus and to which reference is made here by way of abbreviation. The method makes it possible to compensate for differences in speed or travel between different parts of the apparatus, for example between an apparatus part arranged in front of and one behind the rolling unit, and/or to keep the tensile force acting on the strip material substantially constant.

According to a preferred method embodiment, the contact pressure of the pressure unit is controlled as a function of the infeed tensile force measured by the tension measuring device. In particular, the drive power of the motor and the contact pressure of the pressure unit can be controlled in such a way that the drive force acting on the strip material by the strip drive is dynamically controlled between 1 and 120 $N/mm^2$ with respect to the cross-section of the strip material.

According to a possible method embodiment, the strip material can be driven by a second strip drive, which is arranged behind the roller assembly in the direction of movement of the strip material. In this case, the second strip drive can have at least one controllable traction drive unit with a motor, an endless traction mechanism that can be driven by the motor, and a press assembly for pressing the traction mechanism against the strip material. Accordingly, the outfeed tensile force acting on the strip material can be measured by a second tension measuring device arranged between the roller assembly and the second strip drive. The drive power of the motor of the second strip drive can be set to a constant value. Alternatively or additionally, the contact pressure of the pressure unit of the second strip drive can be controlled depending on the outfeed tensile force measured by the second tensile measuring device.

Overall, the apparatus can be controlled with the method in such a way that the speed and/or force of the strip material is suitably adapted to the requirements of the upstream and/or downstream processes. For example, the at least one strip drive can be controlled in such a way that on one side, i.e. the infeed or outfeed side, the longitudinal force acting on the strip material is zero, and on the other side the target tensile force required for the respective process is applied. The setting of a zero tensile force has the advantage that no further device is required to apply a basic tension. It is understood that other tensile forces between zero and the target force can also be set.

SUMMARY OF THE DRAWINGS

A preferred embodiment is explained below with reference to the figures in the drawing. Herein

Figure 6:
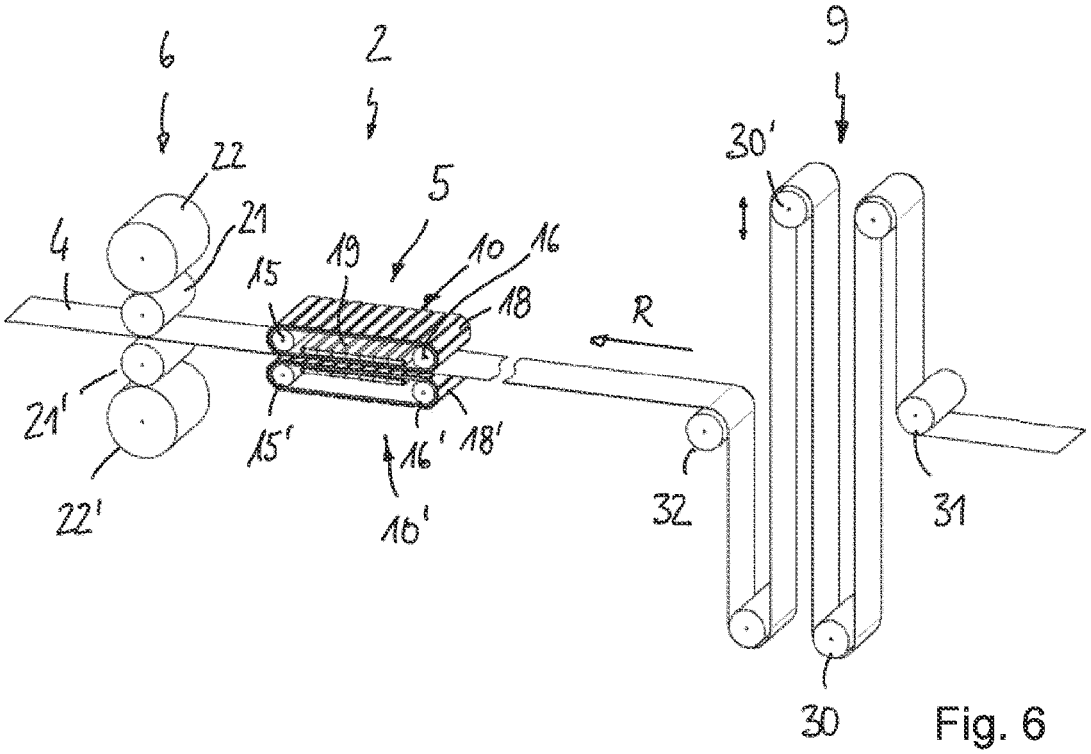
Figure 7:
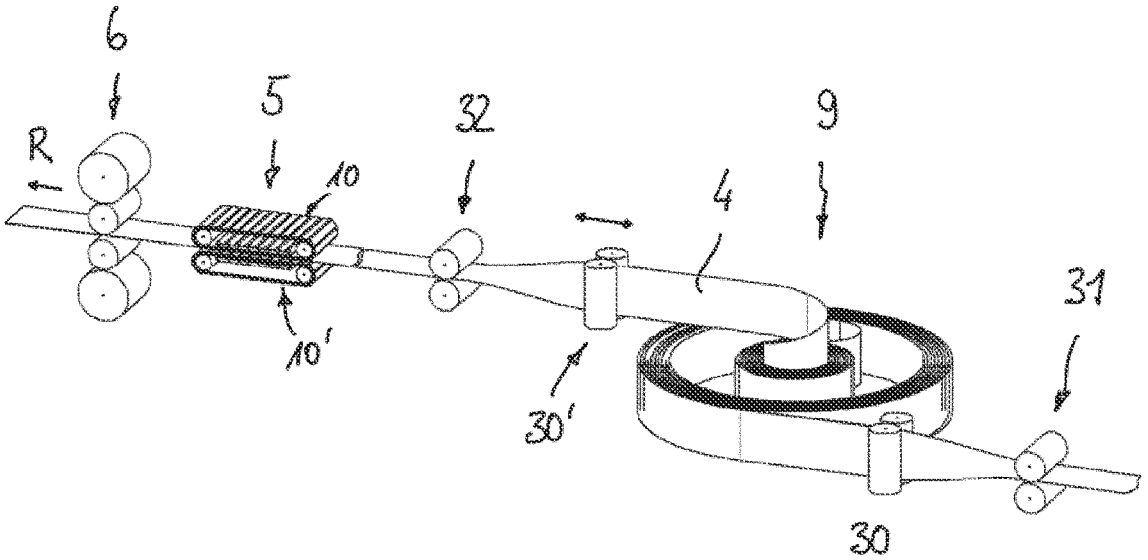

B) in side view;

FIG. 6 shows schematically a buffer for an apparatus in a first embodiment; and FIG. 7 shows a buffer for an apparatus in a further embodiment.

DESCRIPTION

Figure 1:
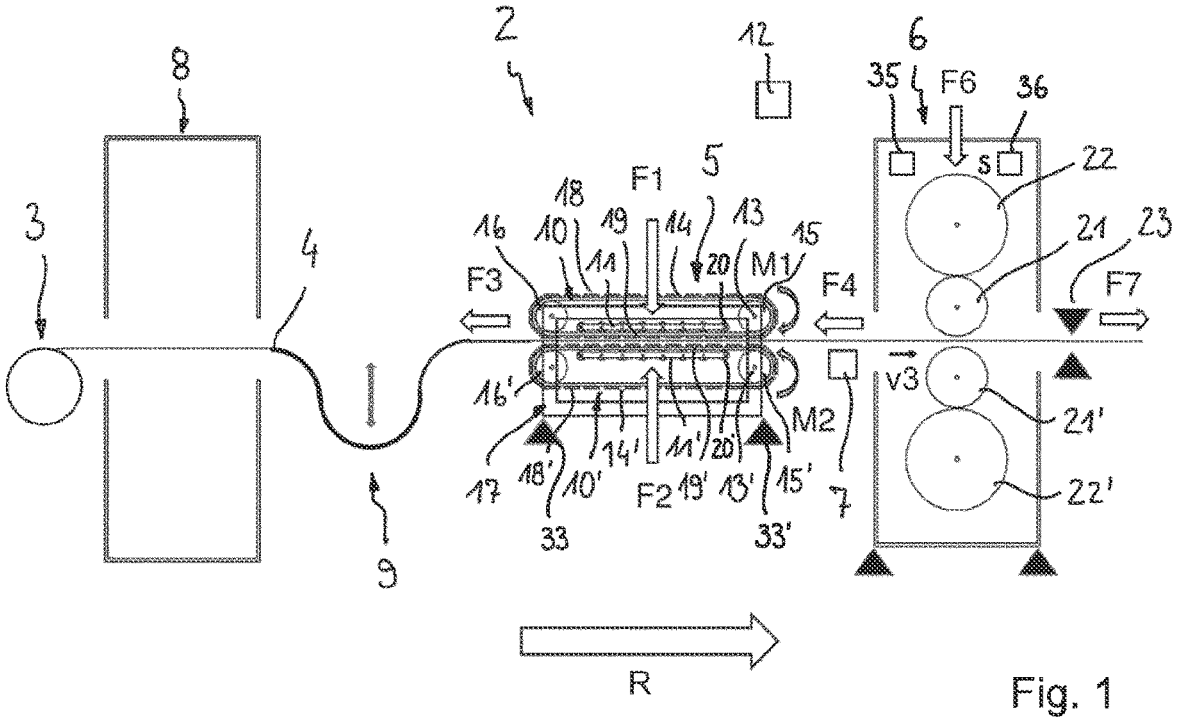
FIG. 1 shows an embodiment of an apparatus for processing metallic strip material.

FIG. 1 shows an apparatus 2 for processing metallic strip material. The apparatus 2 has a feeder 3 for feeding metallic strip material 4, a strip drive 5, a roller assembly 6 for flexible rolling of the strip material 4 and a tension measuring device 7. Optionally, a strip processing unit 8 and/or a strip buffer 9 can be provided between the feeder 3 and the roller assembly 6.

The feeder 3 can be any unit that provides and/or feeds the strip material 4 for the further process steps. For example, a coiler, in particular a lightweight coiler, can be used, which can be designed to essentially carry the coil and apply a winding tension required for the subsequent processes, which in particular can be less than 10 $N/mm^2$, but does not have to apply winding tensions exceeding this.

An optional downstream strip processing unit 8 can be integrated into the apparatus according to technical requirements. For example, a cleaning unit and/or a welding unit for longitudinal or transverse welding of two fed coils can be provided as an additional strip processing unit.

Furthermore, a strip buffer 9 can optionally be provided between the feeder 3 and the rolling unit 6, which is designed to temporarily store sections of the strip material 4 as it passes between a buffer inlet and a buffer outlet and thus compensate for speed variations during the transport of the strip material 4. The strip buffer 9 is designed as a vertical buffer, although other embodiments are also possible.

The strip drive 5 comprises several functional units, which in particular cooperate in pairs, namely a first and a second traction drive unit 10, 10', as well as a first and a second pressure unit 11, 11'. The two press assemblies 11, 11' can be configured to act on an associated one or jointly on both traction drive units 10, 10'. A control unit 12 is also provided for controlling process parameters influencing the transport, in particular the advance speed v3 and/or the tensile force F3, F4 of the strip material 4. It is understood that also just one traction drive unit and/or press assembly can be provided.

The traction drive units 10, 10' each have a motor 13, 13' and an endless traction mechanism 14, 14' which can be driven by the motor. The motor 13, 13' can be drivingly connected to a drive wheel 15, 15', which transmits a driving power of the motor to the traction mechanism 14, 14'. The traction mechanism may be designed as a chain or a toothed belt. The traction drive unit 10, 10' can have a return wheel 16, 16' at the opposite end to the drive wheel 15, 15'. By means of the associated press assembly 11, 11', the respective traction drive unit 10, 10' and, respectively, the associated traction mechanism 14, 14' is pressed against the strip material 4. When using a press assembly acting jointly on the strip material, the two traction drive units 10, 10' can be moved against each other in the transverse direction of the strip material 4. The drive power of the motor 13, 13' and/or the contact pressure force of the pressure unit 11, 11' is variably adjustable during operation, so that a drive force acting on the strip material 4 by the traction mechanism 14, 14' under frictional contact is variably adjustable. The driving power of the motor 13, 13' is used in particular on the basis of the determined tensile force F4 at the inlet of the roll unit 6, wherein it is understood that further input variables, such as the strip speed and/or the roll gap position, can be used.

The traction drive units 10, 10' are held stationary in the longitudinal direction of the strip material 4. A carrier 17 is provided on which a drive wheel 15, 15' and a return wheel 16, 16' of the traction drive unit are each, at a distance from each other, rotatably supported about axes of rotation A15, A16. Alternatively, the traction drive units 10, 10' can each be arranged as a whole on the carrier 17 so as to be fixed in the longitudinal direction and vertically adjustable in the transverse direction. The carrier 17 can be a framework, for example. The carrier 17 can be set up and/or fixed in a stationary manner on a part of the building, in particular by respective supports 33, 33'. The drive wheels 15, 15' can be rotatably driven by the associated motor 13, 13' and transmit torque introduced by the motor to the respective traction mechanism 14, 14'. Suitable form-engaging means can be provided on the drive wheel 15, 15' for this purpose, which form-lockingly engage in opposing form-engaging means of the traction mechanism 14, 14'. The press assemblies 11, 11' can also be mounted on or supported against the carrier 17. A carrier 17 is provided for both traction drive units 10, 10' and press assemblies 11, 11', wherein a design with separate carriers for the upper and lower units is also possible.

The motor(s) 13, 13' can, for example, be configured as a hydraulic motor or electric motor, in particular as a torque motor. The motors 13, 13' are preferably designed to generate high torques and are highly dynamically controllable. In particular, the motors 13, 13', but also the drive components downstream in the power path, are designed and/or configured in such a way that the strip material 4 can be accelerated or decelerated with at least 3 $m/sec^2$. For an even feed and/or an even force application on the upper and lower side of the strip material 4, the first motor 13 for driving the first traction mechanism 14 and the second motor 13' for driving the second traction mechanism 14' are operated synchronously in particular, so that the two traction mechanism 14, 14' are moved with the same rotational speed v14, v14'.

The strip drive 5 and its components, respectively, are in particular configured such that tensile forces of at least 1 $N/mm^2$, preferably at least 10 $N/mm^2$ and/or less than 120 $N/mm^2$ in relation to the cross-sectional area of the strip material 4 can be generated and/or transmitted to the strip material. One or two motors 13, 13' can be provided for driving the first drive wheel and the first axle, respectively. If two motors are used, they can be controlled independently of each other so that one of the two motors can be driven permanently and the other can be switched on as required.

The traction mechanisms 14, 14' each comprise a plurality of interconnected traction mechanism members. Each traction member can have one or more friction elements 18, 18', which are configured to come into frictional contact with the strip material 4 upon rotary movement of the traction mechanisms 14, 14', and to move the strip material 4, which is thus clamped between the two opposing traction assemblies, in the feed direction R. The friction elements 18, 18' are designed and/or adapted to the material of the strip material in such a way that static friction is generated between the friction element and the strip material 4. For transporting a strip material 4 made of a metallic material, in particular steel, the friction lining can in particular contain metallic components such as copper, brass, iron, grey cast iron, in each case as powder or fibres, mineral fibres and/or sulphides of iron, copper, antimony, zinc, tin, molybdenum and/or components made of plastic, which can be embedded in a carrier material, in particular rubber.

The traction mechanism sections 19, 19', which are each in frictional contact with the strip material 4, are each acted upon by an associated pressure unit 11, 11' with a contact pressure force F11, F11' in the direction of the strip material 4, i.e. in the normal direction of the strip material. It can be seen that the two press assemblies 11, 11' are arranged in such a way that the pressing forces F11, F11' are directed towards each other. The strength of the contact pressure can be variably adjusted so that the frictional forces between the friction elements 18, 18' and the strip material 4, which depend on the normal force, can be changed accordingly.

The press assemblies 11, 11' can each have several roller elements 20, 20' which are rotatably mounted on a carrier plate 18, 18'. The roller elements 20, 20' act on a side of the traction members facing away from the strip material 4 and apply pressure to them in the direction of the strip material 4. The contact pressure forces F11, F11' are generated by an actuator (not shown), for example by a hydraulic machine. The actuator is connected in control terms to the electronic control unit, with which the transport process is controlled. In particular, it is provided that the magnitude of the contact pressure forces F11, F11' can be variably adjusted between a maximum value and a minimum value as required by the control unit. The two press assemblies 11, 11' can be acted upon directly against each other by one or more actuators, which are each supported on both press assemblies. Alternatively, a separate actuator can be provided for each press assembly, which is supported on a stationary component.

The tension measuring device 7 is provided behind the strip drive 5 and is designed to measure the tensile forces F4 acting on the strip material 4 between the strip drive 5 and the roller assembly 6. The tension measuring device 7 can also be arranged at another suitable location, for example in the strip drive 5. The measured tensile forces F4 serve as an input variable for controlling the drive power of the motors 13, 13' of the strip drive 5, wherein it is understood that other input variables can be added.

In the processing direction behind the tension measuring device 7, the rolling unit 6 is provided for flexible rolling. During flexible rolling, the strip material 4, which has a substantially constant sheet thickness over its length before flexible rolling, is rolled by rolls (or rollers) 21, 21' in such a way that it is given a variable sheet thickness over its length along the rolling direction. The work rolls 21, 21' are supported by back-up rolls (or rollers) 22, 22'. In this process, a rolling force F6 is exerted on the strip material 4 by the roller assembly 6, wherein the work rolls 21, 21' are supported by the back-up rolls with a supporting force which can correspond to the rolling force. During rolling, the process is monitored and controlled, wherein data obtained from a strip thickness measurement 23 can be used as an input signal to control the rolls 21, 21'. After flexible rolling, the strip material 4 has different thicknesses in the rolling direction. Thereby, starting from the substrate with uniform thickness over the length, the strip material can be rolled out with rolling degrees from 3% to over 40%, in particular in partial sections also over 50%. The initial thickness of the substrate can, for example, be between 0.7 mm and 4.0 mm without being limited thereto. The flexibly rolled material has correspondingly thickness-reduced thicker and thinner strip sections, which are produced according to a predetermined target thickness profile.

An advantage of the apparatus 2 is that by means of the strip drive 5 with traction drive units 10, 10' and controlled drive power M1, M2 of the motors 13, 13' and/or variable drive torque, a very compact arrangement is provided for generating the variable counter traction force required for flexible rolling. This results in a relatively short overall size of the system, independent of any downstream processes. Furthermore, the strip drive 5, by directly controlling the drive power via rapid acceleration or deceleration, enables the setting of a constant rolling tensile force F4 at the inlet side of the rolling unit 4. This is important in flexible rolling insofar as the change in thickness of the strip material technically results in a cyclical strip accumulation. Without further countermeasures, such a strip accumulation at the inlet side of the flexible roller assembly 6 would lead to a reduction of the strip tension. However, by continuously measuring the tensile forces F4 and correspondingly regulating the drive power of the motors 13, 13', i.e. accelerating or braking as required, the tensile force acting on the strip material 4 is kept constant.

With the apparatus 2, the method for processing metallic strip material can be carried out with the steps: driving the strip material by the strip drive 5, the strip material 4 being uncoiled from the feeder 3 and fed to the downstream roller assembly 6 for flexible rolling; sensing a physical variable F4, F6 of an apparatus component acting on the strip material 4 by a suitable measuring device 7; and controlling the drive power of the motor or motors 13, 13' of the strip drive 5 as a function of the determined physical variable F4, F6.

Figure 2:
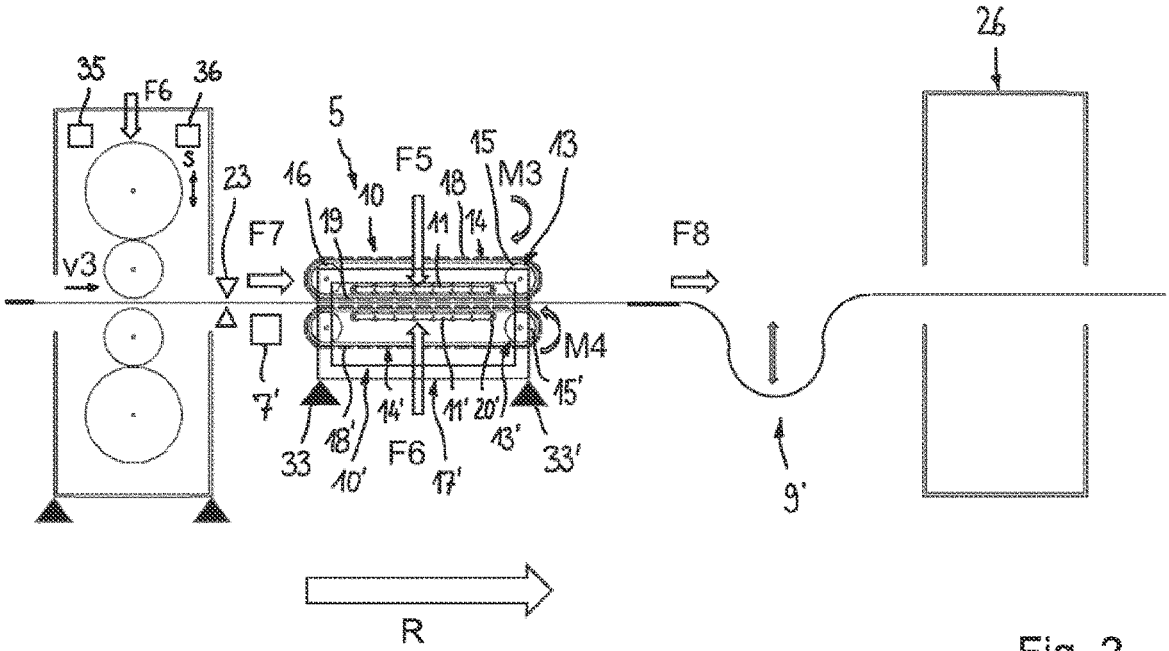
FIG. 2 shows a further embodiment of an apparatus for processing metallic strip material.

FIG. 2 shows a further embodiment of an apparatus 2. Individual units of the embodiment according to FIG. 2 correspond to those in FIG. 1, so that reference is made to the above description with regard to the common features. The same and/or corresponding details are provided with the same reference signs as in FIG. 1.

A special feature of the present embodiment according to FIG. 2 is that a strip drive 5 with traction drive units 10, 10' is used, in the processing direction of the strip material 4, behind the flexible roller assembly 6. The strip drive 5 corresponds to that of FIG. 1 in terms of structure and mode of operation, so that reference is made to the above description by way of abbreviation.

A tension measuring device 7' can be arranged behind the flexible roller assembly 6, i.e. between the roller assembly and the strip drive 5', in order to detect the outfeed tensile force F7 acting on the strip material 4 on the outfeed side. The drive power and/or the drive torque M3, M4 of the motors 13, 13' of the downstream strip drive 5' can be controlled in particular on the basis of the outfeed tensile force F7 determined by the tension measuring device 7'.

As in the above embodiment, the strip drive 5' is stationary fixed to a stationary component, for example to a part of a building, which is shown schematically by the supports 33, 33'.

Behind the strip drive 5', a strip buffer 9' can optionally be provided, in which the strip material 4 can be temporarily accumulated as it passes through.

Behind the strip buffer 9', a further processing unit 26 can be provided, for example a reel, a forming tool, in particular for producing tubes, and/or a cutting device for separating the strip material or a tube produced from it.

In the embodiments according to FIG. 1 and/or according to FIG. 2, it is provided in particular that, as manipulated variable, the torque of the traction drive unit 10 is dynamically changed in order to keep the required constant rolling tension F4, F7 on the inlet side or outlet side, respectively, as a controlled variable between, for example, 50 and 90 $N/mm^2$ constant via fastest acceleration, respectively deceleration with, for example, 3 to 4 $m/sec^2$. This then results in the further process variables speed v3 and rolling force F6. A dynamic change in the manipulated variable is important in flexible rolling because, in terms of the process, a cyclical strip accumulation occurs in front of the roll 6, which causes the strip tensile forces to collapse. The required acceleration and deceleration, respectively, is determined and applied via a direct tension measurement of the tensile force F4 or F7. Depending on the force required, two axles of the traction drive unit 10, 10' are each driven by one or more motors.

As an alternative to the processes described according to FIGS. 1 and 2, in which the strip tensile force as controlled variable is kept substantially constant, according to an alternative embodiment the controlled variable can also be a substantially constant rolling force F6. Here, too, the drive power M1, M2 and/or the torque of the motors 15, 15' is dynamically changed as manipulated variable in order to achieve a rolling force reduction (F6) via a tension increase (F4, F7) or a rolling force increase via tension reduction. The speed v3 of the strip material 3 and the tensile force F4 or F7 result accordingly. The rolling force F6 is determined continuously by a rolling force measuring unit 35. According to a further alternative or supplementary embodiment, a position measuring device 36 can be provided, which can be arranged on a setting unit for a roll 20, 20'; 21, 21' in order to measure the setting position s of a setting unit for one or more rolls as a physical variable.

Figure 3:
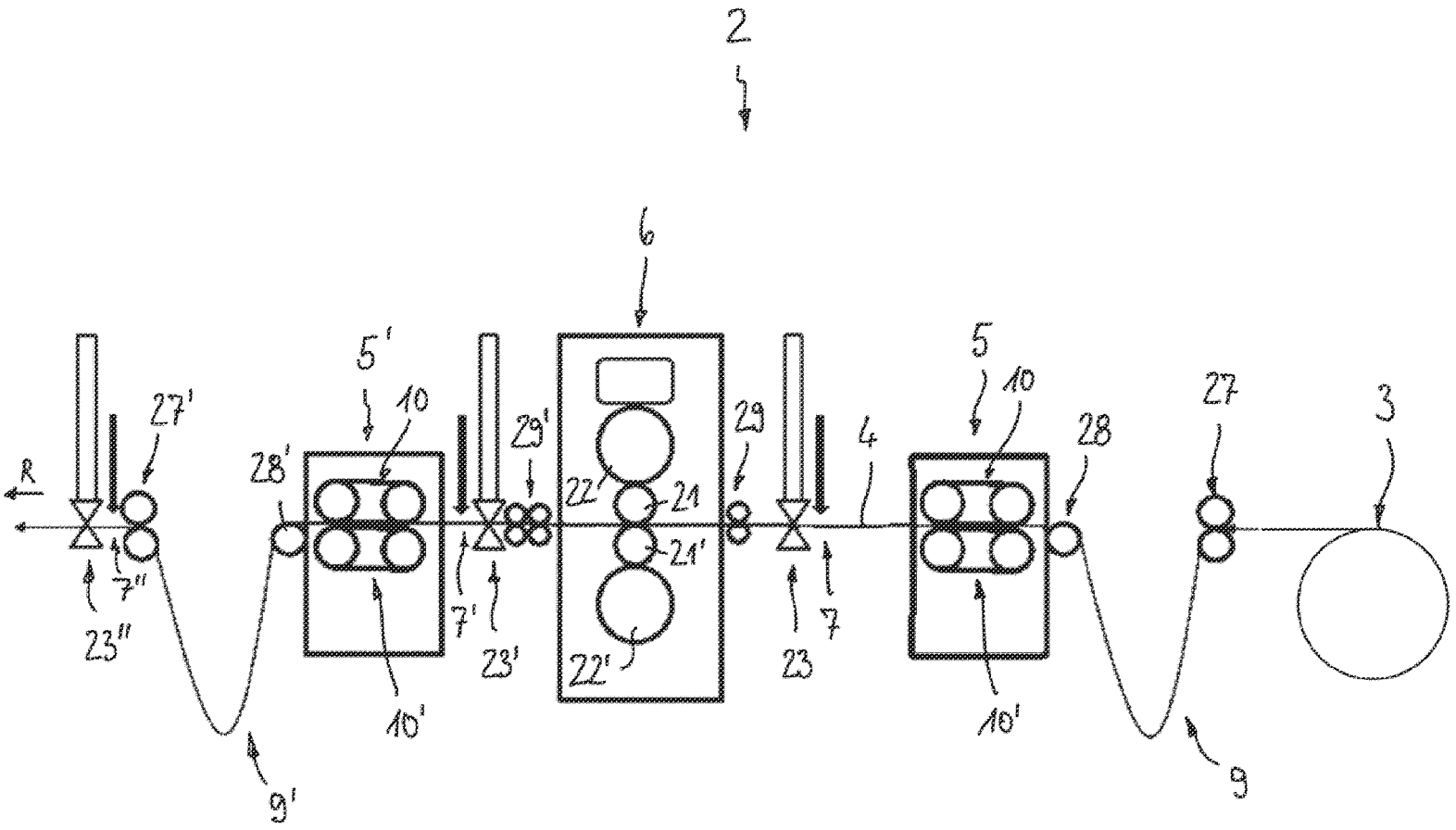
FIG. 3 shows a further embodiment of an apparatus for processing metallic strip material.

Another embodiment is shown schematically in FIG. 3. The arrangement according to FIG. 3 widely corresponds to a combination of that according to FIG. 1 and FIG. 2, so that reference is made to the above description with regard to the common features. The same and/or corresponding details are marked with the same reference signs as in FIG. 1 and FIG. 2.

The present embodiment is characterised in that a first strip drive 5 is arranged in front of the flexible roller assembly 6 and a second strip drive 5' is arranged behind the roller assembly 6. In detail, the apparatus 2 for processing metallic strip material according to FIG. 3 comprises in particular the following units in the processing direction of the strip material 4: a feeder 3, a first strip driver 27, a first strip buffer 9, a first roller28, a first strip drive 5, a first tension measuring device 7, a first measuring unit 23 for measuring the strip thickness and/or strip speed, a first squeezing unit 29, a roller assembly 6 for flexible rolling, a second squeezing unit 29', a second measuring unit 29 for measuring the strip thickness and/or strip speed, a second tension measuring device 7', a second strip drive 5, a second roller 28, a second strip buffer 9, a second strip driver 27 and/or a third measuring unit 23" for measuring the strip thickness and/or strip speed. The squeezing units 29, 29' are cleaners, i.e., are used to squeeze off lubricating liquid used in rolling.

The first strip drive 5 may be as shown in FIG. 1, the description of which is referred to in this respect. The second strip drive 5' may be as shown in FIG. 2, the description of which is referred to in this respect. Due to the use of the strip drives 5, 5' with traction drives 10, 10' and drive control via the rotary motors 13, 13', the system according to FIG. 3 has a particularly short system length, which in particular can be less than 25 metres. A further processing unit can follow behind the third measuring unit 23", for example a cutting or welding unit.

Figure 4:
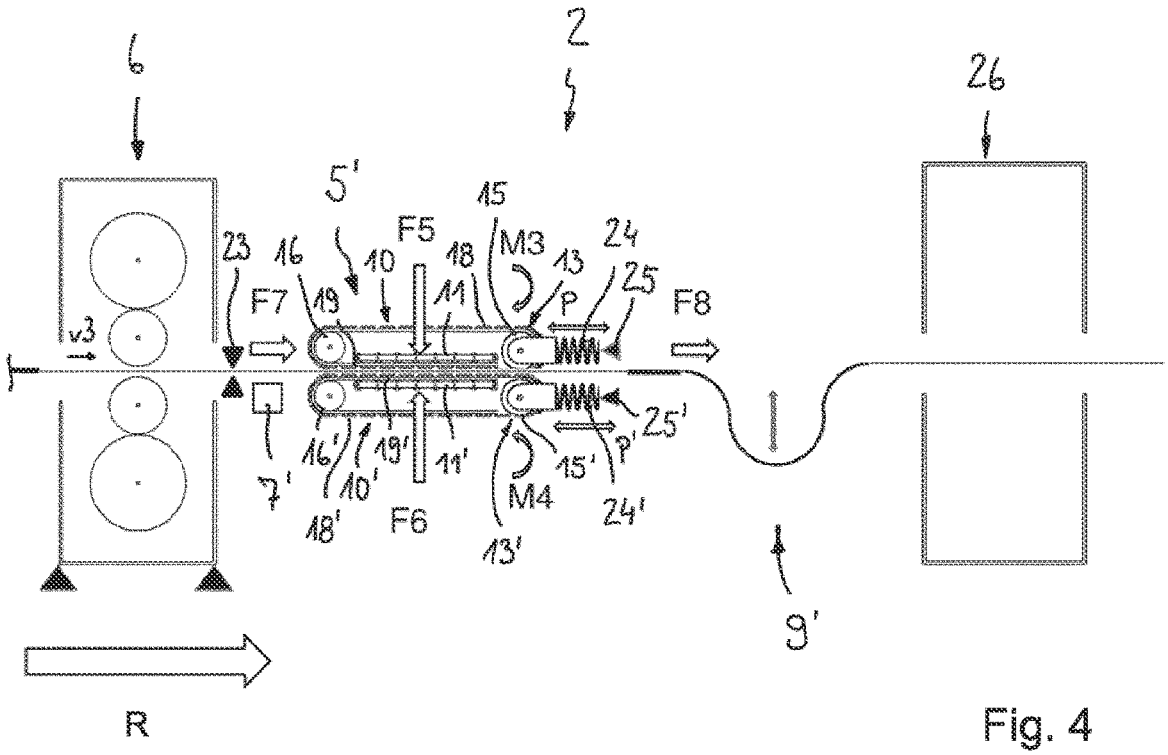
FIG. 4 shows an embodiment of an apparatus for processing metallic strip material.

FIG. 4 shows a system 2 in an alternative or supplementary embodiment. Individual units of the embodiment according to FIG. 4 correspond to those in FIG. 1, so that reference is made to the above description with regard to the common features. The same and/or corresponding details are marked with the same reference signs as in FIG. 1.

A special feature of the present embodiment according to FIG. 4 is the use of a strip drive 5 with traction drive units 10, 10' in the processing direction of the strip material 4 behind the flexible roller assembly 6. The strip drive 5 corresponds in terms of structure and mode of operation to that of FIG. 1, so that reference is made to the above description by way of abbreviation.

Downstream of the flexible roller assembly 6, i.e. between the roller assembly and the strip drive 5', a tension measuring device 7' can be arranged in order to detect the outfeed tensile force F7 acting on the strip material 4 on the outfeed side. The drive power M3, M4 of the motors 13, 13' of the downstream strip drive 5' can be controlled in particular on the basis of the outfeed tensile force F7 determined by the tension measuring device 7'.

In the present embodiment, the strip drive 5' can be moved along the strip material 4 to a limited extent. For this purpose, the strip drive 5' is supported by spring arrangements 24, 24' relative to a stationary component 25, 25'. The spring arrangements 24, 24' enable the strip drive 5' to move elastically in or, respectively, against the strip direction R, which is shown schematically by the arrows P, P'. A separate spring arrangement 24, 24' is provided for each traction drive unit 10, 10', one end of which is supported on a carrier 17, 17' of the drive unit 10, 10' and the other end of which is supported on the stationary component. Alternatively, only one spring system can be provided, which can, for example, be supported on a carrier of the strip drive 5'.

In the arrangement according to FIG. 4, the buffering of the strip accumulation resulting from the flexible rolling process on the exit side of the roll gap, i.e. behind the roll unit 6, can be realised via the elasticity of the traction drive arrangement in connection with the spring arrangement 24, 24'. Since the strip accumulation, respectively the variations of the strip tensile forces F7, F8 at the exit side of the roller assembly are considerably lower than in front thereof, a dynamic control of the drive power of the motors 13, 13' can be dispensed with. Instead, the motors can be operated here with constant drive power and/or constant drive torque M3, M4.

Behind the strip drive 5' with spring support, a buffer 9' can optionally be provided, in which the strip material 4 can be temporarily stored as it passes through.

Behind the strip buffer 9', a further processing unit 26 can be provided, for example a reel, a forming tool, in particular for producing tubes, and/or a cutting device for separating the strip material and/or a tube produced therefrom.

In a further embodiment, the system according to FIG. 1 and the system according to FIG. 4 can be arranged one behind the other and together form a complete system.

Figure 5A:
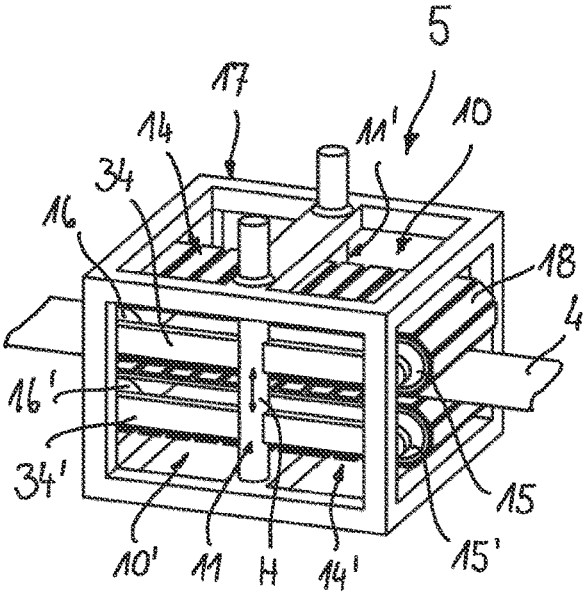
FIG. 5 shows schematically a strip drive for an apparatus according to FIGS. 1, 2 and/or 3 in a modified embodiment A) in three-dimensional representation.
Figure 5B:
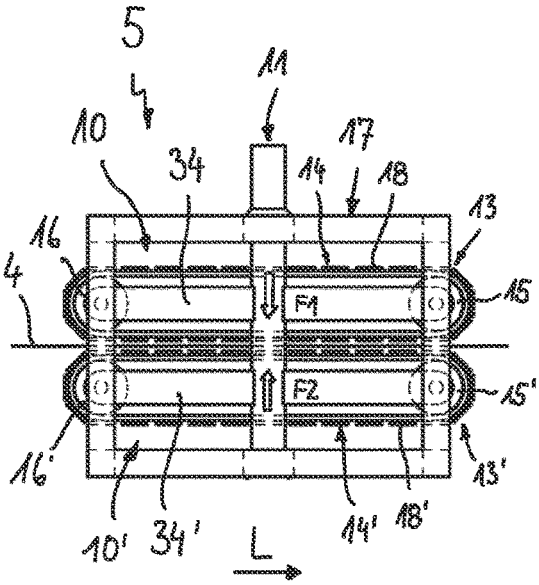

In FIGS. 5A and 5B, which are described together, a strip drive 5 is shown in a slightly modified embodiment, which can be used in an apparatus according to FIGS. 1, 2 and/or 3. The strip drive shown in FIGS. 5A, 5B largely corresponds to the embodiment shown in FIGS. 1 to 3, the description of which is referred to in this respect with regard to the similarities. The same and/or corresponding details are provided with the same reference signs as in the above figures.

The traction drive units 10, 10' are mounted on the carrier 17 so as to be stationary in the longitudinal direction R of the strip material 4 and movable in the transverse direction H to the strip material. The carrier 17 is designed as a scaffold or frame which is set up stationary on a part of the building. The traction drive units 10, 10' each have a carrier 34, 34' on which the respective drive wheel 15, 15', return wheel 16, 16', traction mechanism 14, 14' and motor 15, 15' are mounted and accordingly form a unit. The drive wheels 15, 15' are rotatably drivable by the associated motor 13, 13' and transmit torque introduced by the motor to the respective traction mechanism 14, 14'. The press assemblies 11, 11' are also mounted on or supported against the carrier 17. In the present embodiment, a press assembly 11, 11' is provided on each side of the carrier 17, which can jointly load the traction drive units 10, 10' towards or away from each other. For this purpose, each of the two press assemblies 11, 11' engages the upper carrier 34 on the one hand and the lower carrier 34' on the other hand in order to be able to press them against each other in vertical direction H and thus to be able to exert a pressing force F1, F2 on the strip material 4 passed between the traction drive units 10, 10'. The carriers 34, 34' are each height-adjustable, i.e. in the transverse direction H, guided in the frame 17 and fixed in the longitudinal direction L in the frame. The forces F1, F2 acting between the carriers 34, 34' correspond to each other. The press assemblies 11, 11' can be linear drives, in particular hydraulic piston-cylinder units.

FIG. 6 shows a strip buffer 9 for an apparatus 2 in one embodiment. The present strip storage unit 9 is configured in the form of a vertical buffer and comprises several rollers 30, 30', at least one of which is vertically movable. By vertically moving the roller 30', the path covered by the strip material between the infeed roller 31 and the outfeed roller 32 is changed. In this way, a strip storage is formed in which the strip accumulation generated during flexible rolling can be buffered during the machining process. The strip buffer 9 and/or the displacement paths of the displaceable roller(s) 30' is configured in particular in such a way that a length compensation of at least 100 mm and/or up to 1000 mm is provided. At the outlet side, i.e. behind the flexible rolling unit 6, a strip buffer can be omitted. The strip jam, which is considerably less here, can optionally be buffered here by using a strip drive 5' as shown in FIG. 4 via the elasticity of the traction arrangement in conjunction with the spring arrangement 24, 24'.

FIG. 7 shows a strip buffer 9 for an apparatus 2 in a further embodiment. The strip buffer 9 is designed in the present case in the form of a horizontal buffer and comprises several rollers 30, 30', at least one of which can be moved in a horizontal plane. The horizontal movement of the roller(s) 30' changes the path covered by the strip material between the infeed roller(s) 31 and outfeed roller(s) 32. In this way, a strip accumulator is formed in which the strip jam generated during flexible rolling can be buffered during the machining process. The strip buffer 9 and/or the displacement paths of the displaceable roller(s) 30' are configured in such a way that a length compensation of at least 100 mm and/or up to 1000 mm is possible. At the exit side, i.e. behind the flexible rolling unit 6, a strip buffer can be dispensed with. The strip jam, which is considerably less here, can optionally be buffered here by using a strip drive 5' as shown in FIG. 4 via the elasticity of the traction arrangement in conjunction with the spring arrangement 24, 24'.

The strip buffers 9 shown in FIGS. 6 and 7 can each be used in the systems according to FIGS. 1 to 5.

LIST OF REFERENCE SIGNS

2 apparatus
3 feeder
4 strip material
5 strip drive
6 roll device
7, 7' tension measuring device
8 strip processing unit
9 buffer
10, 10' traction drive unit
11, 11' press-on unit
12 control unit
13, 13' motor
14, 14' traction loop
15, 15 drive wheel
16, 16' return wheel
17 carrier
18, 18' friction element
19, 19' traction loop sections
20, 20' roller element
21, 21' work roll
22, 22' back-up roll
23, 23' thickness measuring unit
24, 24' spring
25, 25' component
26 machining unit
27, 27' strip driver
28, 28' roller
29, 29' squeeze unit
30, 30' rollers
31 infeed roller
32 outfeed roller
33 support
34, 34' support element
35 force measuring device
36 position measuring device
A axis
F power
H transverse direction
L longitudinal direction
M drive torque
P arrow
R feed direction
s position

The invention claimed is:

1. An apparatus for processing metal strip material, comprising:

a feeder;

a strip driver which has at least one controllable traction drive with at least one motor and a traction loop rotatably drivable by the motor, and a press assembly arranged to press the traction loop against the strip material, wherein a driving force is transmittable from the traction loop, under frictional contact with the strip material, to the strip material;

a plurality of rollers arranged to produce a variable sheet thickness in the strip material over the length of the strip material by varying a roll gap;

a measuring device arranged to measure a physical variable acting on the strip material;

wherein the at least one traction drive is fixed in longitudinal direction of the strip material; and a control unit configured to control a drive torque of the motor based on the physical variable measured by the measuring device, wherein, by changing the drive torque of the motor, the driving force from the traction drive acting on the strip material is variably adjustable.

2. The apparatus according to claim 1, wherein the measuring device is a tension measuring device which is arranged between the strip drive and the rollers in order to measure, as a physical variable, an infeed tensile force acting on the strip material.

3. The apparatus according to claim 1, wherein the measuring device is a force measuring device which is arranged on one of the rollers in order to measure, as a physical variable, a rolling force of the rollers acting on the strip material.

4. The apparatus according to claim 1, wherein the measuring device is a position measuring device which is arranged on a setting unit of the rollers in order to measure as a physical variable a setting position of a roller acting on the strip material.

5. The apparatus according to claim 2, wherein a second strip driver is arranged downstream of the rollers in the direction of movement of the strip material, with the second strip driver having at least one second controllable traction drive with a motor, a second traction loop that is rotatably drivable by the motor, and a second press assembly for pressing the second traction loop against the strip material;

wherein a second tension measuring device is arranged between the rollers and the second strip driver to measure the outfeed tensile force acting on the strip material on the outfeed side, wherein the drive power of the motor of the second strip driver is variably controlled on the basis of the outfeed tensile force measured by the second tension measuring device.

6. The apparatus according to claim 5, wherein, for at least one of the first and second strip drives, the pressure of the respective press assembly is variably controlled on the basis of the tensile force measured by respective first or second tension measuring device.

7. The apparatus according to claim 1, wherein a strip buffer is provided in which the strip material is storable as it passes between a buffer inlet and a buffer outlet.

8. The apparatus according to claim 7, wherein the strip buffer includes a vertical buffer, a horizontal buffer, or a loop buffer.

9. The apparatus according to claim 1, wherein the motor is a hydraulic motor or an electric motor.

10. The apparatus according to claim 1, wherein the strip drive is configured to generate tensile forces of at least 1 $N/mm^2$ and of less than 120 $N/mm^2$ with respect to the cross-sectional area of the strip material;

wherein, when a strip material made of steel is used, the strip drive is configured to generate tensile forces of at least 50 $N/mm^2$ with respect to the cross-sectional area of the strip material.

11. The apparatus according to claim 1, wherein the strip drive is configured to accelerate and decelerate the strip material at a rate of at least 3 $m/sec^2$.

12. The apparatus according to claim 1, wherein the strip drive comprises two traction drives, with the two traction drives each having a drivable first axle which is rotatably drivable by the motor to transmit a drive torque to the respective traction loop and a second axle which is rotatably driven by the respective traction loop.

13. The apparatus according to claim 1, wherein two controllable traction drives are provided, between which the strip material is passed through with frictional contact, so that the strip material during operation of the traction drives is moved in a direction of movement of traction loop sections in contact with the strip material, wherein the respective press assembly exerts pressure on the respective traction loop towards the strip material.

14. The apparatus according to claim 1, wherein a strip cleaner is arranged between the feeder and the strip drive.

15. The apparatus according to claim 5, wherein the second strip drive is supported against a stationary component at least by a spring, wherein the power of the motor of the second strip drive can be kept constant.

16. A method of processing metal strip material comprising:

driving the strip material by a strip drive, wherein the strip material is uncoiled from a feeder and fed to downstream rollers for flexible rolling, wherein the strip drive includes at least one controllable traction loop which is rotatably drivable by a motor, and a press assembly arranged to press the traction loop against the strip material;

sensing a physical value acting on the strip material by a measuring device arranged on the rollers for flexible rolling or its periphery;

wherein the at least one traction loop is fixed stationarily in the longitudinal direction of the strip material to a stationary part, and wherein the drive torque of the motor is controlled as a function of the physical value measured by the measuring device, with the drive force acting on the strip material by the traction loop being varied by changing the drive torque of the motor.

17. The method according to claim 16, wherein a tension measuring device is used as the measuring device in order to measure an infeed tensile force acting on the strip material as a physical value.

18. The method according to claim 16, wherein a force measuring device is used to measure, as a physical value, a rolling force of the rollers acting on the strip material, or that a position measuring device is used to measure as a physical value a setting position of a roll acting on the strip material.

19. The method according to claim 16, wherein a pressing force of the press assembly is controlled in dependence on the physical value determined by the measuring device, wherein the drive power of the motor and the pressing force of the press assembly are controlled in such a way that the driving force acting on the strip material by the strip drive is controlled dynamically between 1 and 120 $N/mm^2$ with respect to the cross-section of the strip material.

20. The method according to claim 16, further comprising:

driving the strip material by a second strip drive which is arranged downstream of the rollers in the direction of movement of the strip material, with the second strip drive comprising at least one second controllable traction drive with a motor, a traction loop drivable by the motor, and a press assembly for pressing the traction loop against the strip material;

sensing a run-out tensile force acting on the strip material by a second tension measuring device arranged between the rollers and the second strip drive; and setting the drive power of the motor of the second strip drive to a constant value and controlling the pressing force of the press assembly of the second strip drive depending on the run-out tensile force measured by the second tension measuring device.

* * * * *